US007635222B2

(12) United States Patent
Plourde et al.

(10) Patent No.: US 7,635,222 B2
(45) Date of Patent: Dec. 22, 2009

(54) RECLOSABLE PACKAGE HAVING ZIPPER DISPOSED WITHIN LOOP ON FRONT WALL

(75) Inventors: Eric Paul Plourde, Homewood, IL (US); John H. Pilarski, Milwaukee, WI (US); Rusty Koenigkramer, Nanuet, NY (US); Kenny E. McCracken, Lawrenceville, GA (US)

(73) Assignee: Illinois Tool Works Inc., Glenview, IL (US)

( * ) Notice: Subject to any disclaimer, the term of this patent is extended or adjusted under 35 U.S.C. 154(b) by 727 days.

(21) Appl. No.: 11/228,608

(22) Filed: Sep. 16, 2005

(65) Prior Publication Data

US 2007/0062157 A1 Mar. 22, 2007

(51) Int. Cl.
*B65D 33/16* (2006.01)

(52) U.S. Cl. ..... 383/63; 383/64; 383/200; 383/204; 383/207; 383/61.2; 383/66

(58) Field of Classification Search ..... 383/63, 383/66, 120
See application file for complete search history.

(56) References Cited

U.S. PATENT DOCUMENTS 3,228,583 A * 1/1966 Dougherty ..... 383/9
3,249,288 A * 5/1966 Repko ..... 383/204
4,848,928 A * 7/1989 Ausnit ..... 383/5
5,215,380 A * 6/1993 Custer et al. ..... 383/203
5,461,845 A * 10/1995 Yeager ..... 53/451
5,480,230 A * 1/1996 May ..... 383/9
6,017,412 A * 1/2000 Van Erden et al. ..... 156/290
6,361,209 B1 * 3/2002 LaRue et al. ..... 383/10
6,530,870 B2 * 3/2003 Buchman et al. ..... 493/394
7,325,378 B2 * 2/2008 Ausnit ..... 53/412
2001/0017947 A1 * 8/2001 Strand et al. ..... 383/61
2006/0177156 A1 * 8/2006 Owen et al. ..... 383/63
2006/0207221 A1 * 9/2006 Ausnit ..... 53/412

* cited by examiner

*Primary Examiner*—Nathan J Newhouse
*Assistant Examiner*—Devin Salmon
(74) *Attorney, Agent, or Firm*—Ostrager Chong Flaherty & Broitman P.C.

(57) ABSTRACT

A package comprising: a receptacle comprising front and rear walls joined to each other at top and bottom cross seals and connected to each other along first and second sides of the receptacle, the front wall comprising a loop that projects outward and that extends across the front wall from the first side to the second side of the receptacle; and a pair of zipper strips having mutually interlocked profiles, the zipper strips being disposed inside and joined to the loop.

9 Claims, 7 Drawing Sheets

RECLOSABLE PACKAGE HAVING ZIPPER DISPOSED WITHIN LOOP ON FRONT WALL

BACKGROUND OF THE INVENTION

The present invention relates to reclosable plastic bags of the type in which food products, such as chips and cereal, and other goods are packaged for sale to consumers. More particularly, the present invention relates to reclosable plastic bags manufactured and filled on form-fill-seal (FFS) machines, wherein a series of interlocked plastic zipper strips are attached at bag-length intervals transversely to the longitudinal axis of the thermoplastic film material used to form the reclosable bags on the FFS machine.

The present invention relates to improvements in the package-making art and may be practiced in the manufacture of thermoplastic bags and packages of the kind that may be used for various consumer products, but which are particularly useful for food products which must be kept in moisture and air-tight packages, free from leakage until initially opened for access to the product contents, which packages are then reclosable by zipper means to protect any remainder of the product therein. The prior art is fairly well-developed, but nevertheless remains susceptible to improvement contributing to increased efficiency and cost effectiveness.

One problem that accompanies reclosable packages produced from a continuous supply of thermoplastic film material on FFS machines is the difficulty in attaining a satisfactory sealing of the bag or package against leakage, particularly where the zipper and area of film engaged by the zipper extends through the side (cross) seal areas separating one bag or package from the next. This problem occurs where the zipper is attached parallel to the longitudinal axis of the thermoplastic film material used to form the reclosable bags on the FFS machine, in which case the transverse, or side, sealing bars must flatten and seal the zipper at the same time they are sealing the thermoplastic film from which the packages are being made. It is difficult to consistently and successfully make leakproof packages using this technique unless the zipper ends have been spot sealed at the cross seal location in an earlier operation.

In addition, the length of reclosable packages made on FFS machines wherein the zipper is attached parallel to the longitudinal axis of the thermoplastic film is limited to the diameter of the filling tube of the FFS machine. Thus, generally bags of this type are wider than they are long. While such bags are suitable for certain products where shorter bags are desirable, such as cheese and chicken parts, these bags are not suitable for applications in which longer bags are desirable, for example, chips and other snack foods.

Among the approaches taken to solve these problems has been the substitution of a transverse zipper for the longitudinal zipper. A method and apparatus for making reclosable bag material and reclosable bags on an FFS machine utilizing transverse zippers is disclosed in U.S. Pat. No. 6,017,412.

When a transverse zipper is provided, the cross-sealing bars associated with the FFS machine do not flatten the zipper profile during formation of the top and bottom seals of the package since the transverse sealing bars may seal the zipper to the thermoplastic sheet material transversely thereacross without contacting the zipper profile. In addition, when a transverse zipper is used, the length of the packages made on the FFS machine can be varied without varying the length of the transverse zipper segment and is not limited to the diameter of the filling tube.

There is a continuing need for improvements in methods of manufacturing reclosable packages using an FFS machine wherein zippers are transversely applied to a web of packaging material before it enters the FFS machine.

BRIEF DESCRIPTION OF THE INVENTION

The invention is directed to a reclosable package having a loop extending transversely across its front wall or panel, which loop shrouds a zipper disposed therein and joined thereto. The invention is also directed to methods of manufacturing such a reclosable package.

One aspect of the invention is a package comprising: a receptacle comprising front and rear walls joined to each other at top and bottom cross seals and connected to each other along first and second sides of the receptacle, the front wall comprising a loop that projects outward and that extends across the front wall from the first side to the second side of the receptacle; and first and second zipper strips having mutually interlocked profiles, the first and second zipper strips being disposed inside and joined to the loop.

Another aspect of the invention is a package comprising: a receptacle comprising a web of packaging material that has been folded and sealed to form upper and lower front panels, a loop connected to the upper and lower front panels, and upper and lower rear panels, the upper front panel and the upper rear panel being joined to each other along a top transverse seal and connected to each other along first and second sides of the receptacle, and the lower front panel and the lower rear panel being joined to each other along a bottom transverse seal and connected to each other along the first and second sides of the receptacle; and first and second zipper strips having mutually interlocked profiles, the first and second zipper strips being disposed inside and joined to the loop.

A further aspect of the invention is a method of manufacture comprising the following steps: (a) paying out a length of a web of packaging material having a constant web width measured in a transverse direction from a first lateral edge to a second lateral edge thereof; (b) joining a length of a zipper strip having a constant closure profile to the length of web along a zone of joinder that extends across an intermediate portion of a transverse section of the length of web, the length of first zipper strip being not greater than one half of the web width; (c) forming a transverse loop having first and second sides in the length of web, the intermediate portion of the transverse section of the length of web being a part of the first side of the loop; (d) forming the length of web into a tube with the loop projecting outward by joining together first and second longitudinal portions of the length of web disposed in respective marginal areas bounded by the first and second lateral edges; (e) cross sealing the tube along first and second transverse zones that are separated by a distance along the length of web; and (f) cutting the tube along first and second cut lines to form an individual package that is cross sealed at a top and a bottom.

Yet another aspect of the invention is a method of making a reclosable package on a form-fill-seal machine comprising the following steps: (a) paying out a length of a web of packaging material from a supply roll, the length of web having a constant width measured in a transverse direction from a first lateral edge to a second lateral edge of the length of web and comprising a transverse loop having a pre-applied zipper disposed therein and joined thereto; (b) forming the length of web into a tube with the loop projecting outward by joining together first and second longitudinal portions of the length of web disposed in respective marginal areas bounded by the first and second lateral edges; (c) cross sealing the tube along first and second transverse zones that are separated by a distance along the length of web; and (d) cutting the tube along first and second cut lines to form an individual package that is cross sealed at a top and a bottom.

Other aspects of the invention are disclosed and claimed below.

BRIEF DESCRIPTION OF THE DRAWINGS

Reference will now be made to the drawings, in which similar elements in different drawings bear the same reference numerals.

DETAILED DESCRIPTION OF THE INVENTION

Figure 1:
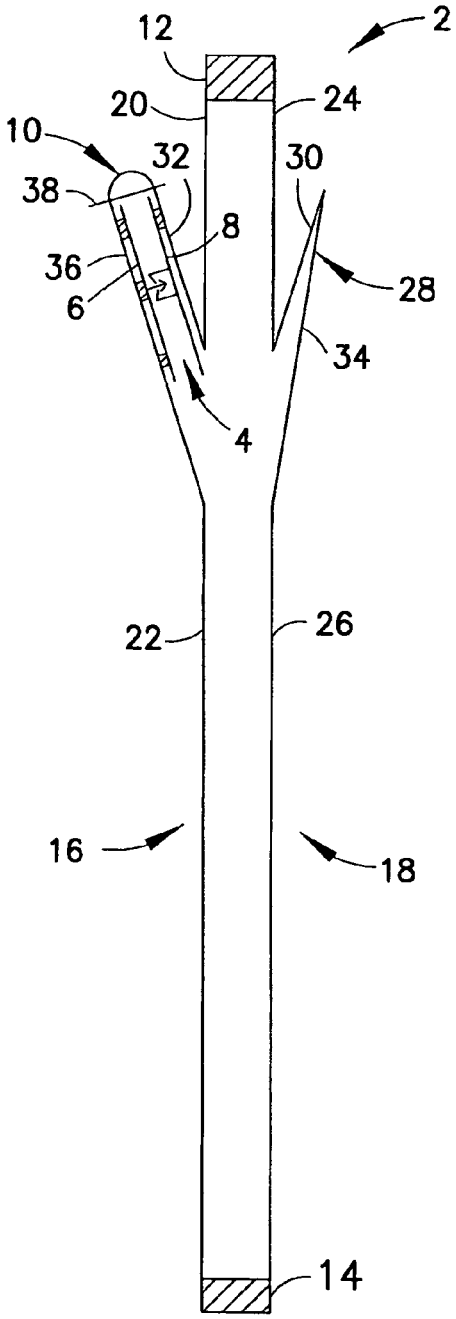
FIG. 1 is a drawing showing a sectional view of a reclosable package in accordance with one embodiment of the invention.

FIG. 1 shows a sectional view of a reclosable package in accordance with one embodiment of the present invention. The package comprises a receptacle 2 that, upon completion of the manufacturing process, has an interior volume that is at least partially filled with product (not shown in FIG. 1 or other drawings) and that is sealed to prevent the admission of air from the ambient atmosphere.

The receptacle 2 is made by folding and sealing a web of packaging material. The packaging material may be a monolayer made of thermoplastic film or paper or a laminate comprising two or more layers of thermoplastic material, a layer of paper coated with thermoplastic material or metalized thermoplastic film. In the examples disclosed herein, the packaging material is a web of thermoplastic film that has been folded and sealed to provide the receptacle structure depicted in FIG. 1. The receptacle is constructed by wrapping the web of packaging material into a tube shape having overlapping marginal portions at the lateral edges of the web, and then sealing those overlapping marginal portions together to form a tube. That tube is later flattened and then sealed in respective transverse (mutually parallel) band-shaped zones to form top and bottom cross seals 12 and 14 that enclose an interior volume of the receptacle. In the case wherein the zipper and receptacle are made of thermoplastic materials, the cross seals 12 and 14 may be formed by conductive heat sealing, adhesive bonding, ultrasonic welding, or any other conventional technique for sealing thermoplastics. In a finished package, the interior volume of the receptacle is at least partially filled with a mass of product (not shown in FIG. 1).

As a result of the aforementioned cross sealing, the receptacle 2 is configured to have a front wall 16 and a rear wall 18, which extend from the top cross seal 12 to the bottom cross seal 14 and are connected (not joined) to each other at the sides of the receptacle. The sides of the receptacle are typically formed by folding the web of packaging material, although there may be little if any fold line in cases where the sides are formed by respective loops of web having gradual curvature rather than sharp folds that form a vertex. The front wall has no vertical seal, but the rear wall has a vertical seal (not shown in FIG. 1), along which two marginal portions of the web are fin or lap sealed together to form a rear wall having two sections joined by the vertical seal.

In accordance with the embodiment shown in FIG. 1, the front wall 16 comprises an upper front panel 20, a lower front panel 22 and a loop 10 that is connected to the upper and lower front panels. The loop 10 shrouds a zipper 4. Similarly, the rear wall 18 comprises an upper rear panel 24, a lower rear panel 26 and a flap 28 that is connected the upper and lower rear panels. The upper front panel 20 and the upper rear panel 24 are joined to each other along the top cross seal 12 and connected to each other along first and second sides of the receptacle (not shown in FIG. 1). Similarly, the lower front wall 22 and the lower rear panel 26 are joined to each other along the bottom cross seal 14 and connected to each other along the first and second sides of the receptacle.

As previously mentioned, the rear wall 18 comprises a vertical seal (not shown). The upper rear panel 24 comprises two sections (not shown) joined by a first segment of the vertical seal; the lower rear panel comprises two sections (not shown) disposed on opposite sides of the vertical seal. The flap 28 also comprises two sections that are joined by the vertical seal on the rear wall 18. Although not apparent from the sectional view given in FIG. 1, the respective sections of the flap 28 are connected to the loop 10 at the sides of the receptacle. In fact, the flap sections are continuations of the loop that shrouds the zipper. More specifically, the front side 30 of the flap 28 is a continuation of the rear side 32 of the loop 10, while the rear side 34 of the flap is a continuation of the front side 36 of the loop 10, the primary difference in structure between the loop 10 and the flap 28 being attributable to the presence of the zipper 4 inside the loop 10.

In accordance with the embodiment depicted in FIG. 1, the zipper 4 comprises a pair of zipper strips 6 and 8 having mutually interlocked closure profiles. The zipper strips are disposed inside the loop 10, with zipper strip 6 being joined to the front side 36 of the loop 10 and zipper strip 8 being joined to the rear side 32 of the loop 10. The zipper strips depicted in FIG. 1 have respective flanges. The flange of zipper strip 6 is joined to the front side 36 of the loop 10 in three mutually parallel band-shaped zones by means of respective permanent seals (indicated by hatching) formed by conventional conductive heat sealing. However, three zones of joinder are not required. One zone of joinder, preferably on the consumer side flange, would be sufficient. For example, the flange of zipper strip 6 could be joined to the front side 36 of the loop 10 by a single permanent seal located directly behind the closure profile of the zipper strip 6. Still referring to FIG. 1, the flange of zipper strip 8 is joined to the rear side 32 of the loop 10 in a single band-shaped zone by means of a permanent seal (again indicated by hatching) formed by conventional conductive heat sealing.

Although FIG. 1 shows a rib and groove arrangement, the closure profiles of the zipper strips may take any form. Alternatively, the zipper may comprise interlocking alternating hook-shaped or ball-shaped closure elements. The zipper strips 6 and 8 are made of thermoplastic material. The preferred zipper material is polyethylene or polypropylene. To facilitate the joinder of the zipper flanges to the receptacle walls, the zipper flanges may have a surface layer of sealant material that melts at a temperature lower than the melting point of the material making up the remainder of the zipper.

Alternatively, the zipper strips could be flangeless, in which case the backs of the respective zipper strips would be joined to the respective sides of the loop by respective permanent seals. The closure profiles of the zipper strips may comprise a rib-and-groove arrangement, interengageable hook-shaped members, interengageable ball-shaped members, or any other known type of interengageable members.

As indicated in FIG. 1 by the short dashed line designated by numeral 38, the cap of the loop 10 can be torn away to provide access to the zipper 4. This can be accomplished by providing respective transverse lines of weakened tear resistance (hereinafter "tear lines") that are formed in the front and rear sides of the loop 10 as well as a pair of longitudinal lines of weakened tear resistance or tear lines that connect the transverse tear lines, thereby allowing a rectangular portion of the web material to be removed, which rectangular portion constitutes the aforementioned tear-away cap of the loop 10. To facilitate tearing away of the loop cap, instead of the transverse and longitudinal tear lines meeting at a right angle, a curved or angled tear line connecting segment may be provided in place of the right-angled intersection. The tear lines may be formed by conventional means. For example, each tear line may comprise a line of spaced perforations, a scoreline comprising a line of thinned material or a line of impregnation with an agent that weakens tear resistance, and so forth.

To facilitate tearing open, the cap of loop 10 may be further provided with a plastic tear bead (not shown), which is typically gripped between the forefinger and the thumb by the consumer. This allows the cap of the loop (i.e., the portion of the loop above the dashed line 38) to be torn off, thereby allowing the consumer to have access to the zipper. The consumer can then gain access to the contents of the reclosable bag by pulling apart the zipper strips.

Optionally, the front side 30 of the flap 28 may be joined to the upper rear panel 24 and/or the portion of the rear side 32 of the loop 10 below the tear line may be joined to the upper front panel 20 to more closely mimic the appearance of a conventional bag with a zippered mouth at its top.

Figure 2:
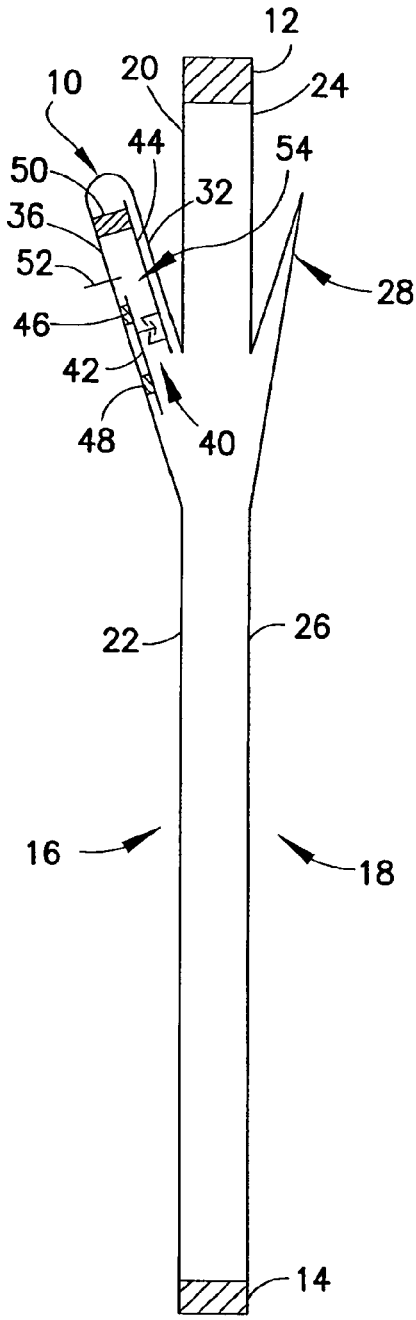
FIG. 2 is a drawing showing a sectional view of a reclosable package in accordance with another embodiment of the invention.
Figure 3:
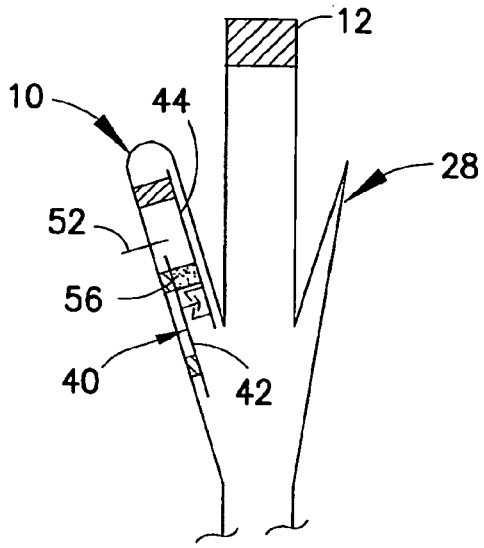
FIGS. 3-7 are drawings showing sectional views of respective reclosable packages in accordance with variations of the embodiment depicted in FIG. 2.
Figure 4:
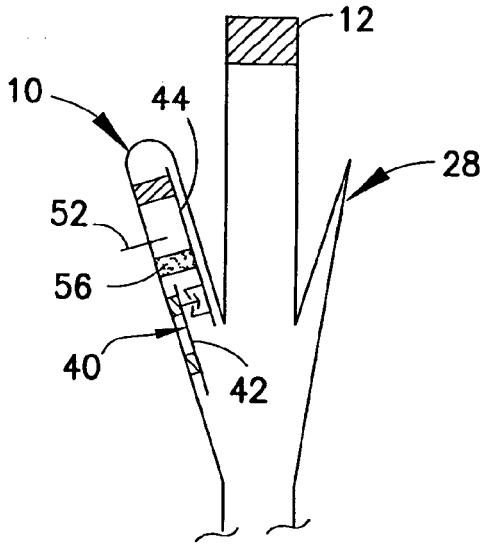
Figure 5:
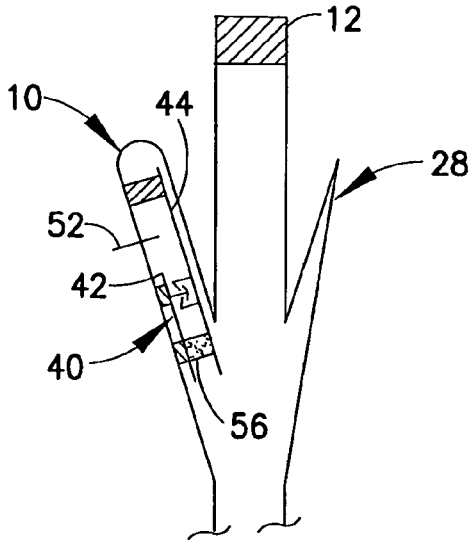
Figure 6:
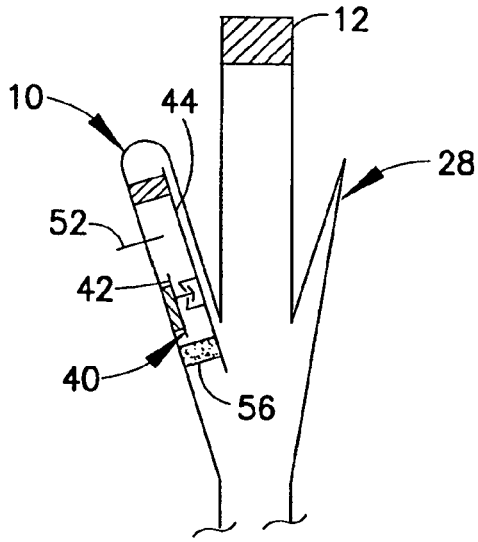

In accordance with an alternative embodiment shown in FIG. 2, the zipper is attached to the front side of the loop and is not attached to the rear side of the loop. For this embodiment, the zipper shown in FIG. 2 is designated by the numeral 40 to distinguish it from zipper 4 shown in FIG. 1. The structure of the receptacle shown in FIG. 2 may be substantially identical to the structure of the receptacle shown in FIG. 1, except for the configuration of the means for tearing open the loop 10, as will be explained in detail below.

In the embodiment shown in FIG. 2, the zipper comprises a pair of zipper strips 42 and 44 having mutually interlocked closure profiles. The zipper strips 42 and 44 are disposed inside the loop 10, with both zipper strips being joined to the front side 36 of the loop 10. The zipper strips depicted in FIG. 2 have respective flanges. The flange of zipper strip 42 is joined to the front side 36 of the loop 10 in two mutually parallel band-shaped zones by means of respective permanent heat seals 46 and 48. However, two zones of joinder are not required. One zone of joinder would be sufficient. For example, the flange of zipper strip 42 could be joined to the front side 36 of the loop 10 by a single permanent seal located directly behind the closure profile of the zipper strip 42. Still referring to FIG. 2, the flange of zipper strip 44 is joined to the front side 36 of the loop 10 in a single band-shaped zone by means of a permanent seal 50.

Instead of a tear-away cap, the loop 10 shown in FIG. 2 may be provided with frangible means for enabling the consumer to make an opening in the front side 36 of the loop 10, thereby allowing access to the zipper 40. The closure profiles of the zipper are in turn disengaged from each other to allow access to the contents in the interior volume of the receptacle 2. The aforementioned frangible means may comprise a line of weakened tear resistance 52 that extends transversely across a portion of the front side 36 of the loop 10. The tear line 52 (indicated by a short dashed line in FIG. 2) may be formed by conventional means, as previously described. The tear line 52 may be connected at its ends to respective vertical tear lines (not shown) that extend vertically downward to form a tear line in the shape of a wide inverted U. When such a tear line is sundered, a flap of material can be folded downward to form an opening in the front side 36 of the loop 10. In accordance with a further alternative, an oval or elliptical or lozenge-shaped tear line could be provided in the front side 36 of the loop 10, allowing the portion of the front side 36 of the loop 10 that is bounded by the tear line to be completely torn away. In the embodiment shown in FIG. 2, the opening formed by tearing is situated such that the consumer may gain access to a space 54 bounded by the interlocked closure profiles of the zipper, the flange of zipper strip 44, and the permanent seal 50. The closure profiles can be readily disengaged from each other when the interior space 54 is accessible to the consumer.

Variations of the embodiment shown in FIG. 2, each variation incorporating a tamper-evident feature, are respectively shown in FIGS. 3-7. The bag shown in FIG. 3 has the same structure as the bag shown in FIG. 2, except that a peel seal 56 is placed between the zipper flanges on the consumer side of the closure profiles of the zipper 40. In the embodiment shown in FIG. 4, a peel seal 56 is placed between the flange of the zipper strip 44 and the front side of the loop 10, again on the consumer side of the interlocked closure profiles. The bag shown in FIG. 5 has a peel seal 56 placed between the zipper flanges on the product side of the closure profiles. In the embodiment shown in FIG. 6, a peel seal 56 is placed between the flange of the zipper strip 44 and the front side of the loop 10 on the product side of the closure profiles.

Figure 7:
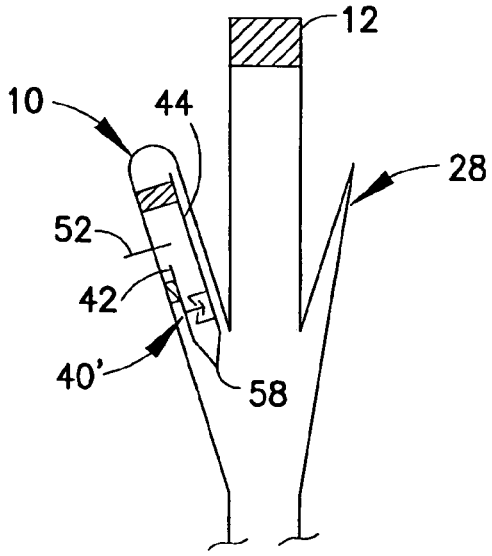

In accordance with a further embodiment shown in FIG. 7, the zipper flanges 42 and 44 can be extended and connected at a cusp 58 to form an internal membrane that blocks access to the interior volume of the receptacle even after the tear line 52 has been sundered and the zipper has been opened. A tear line (not shown) is provided at the cusp 58 to facilitate breaching of the membrane. That tear line extends the length of the zipper. In one implementation, the tear line may comprise a line of spaced perforations that is capped by a sealing stripe as taught in U.S. Pat. No. 5,063,639. The sealing stripe effectively seals the perforations while still leaving the line of weakened tear resistance provided by the perforations.

Figure 8:
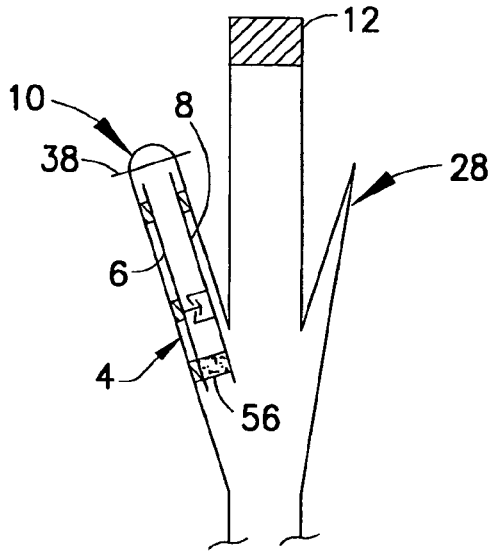
FIGS. 8-10 are drawings showing sectional views of respective reclosable packages in accordance with variations of the embodiment depicted in FIG. 1.
Figure 9:
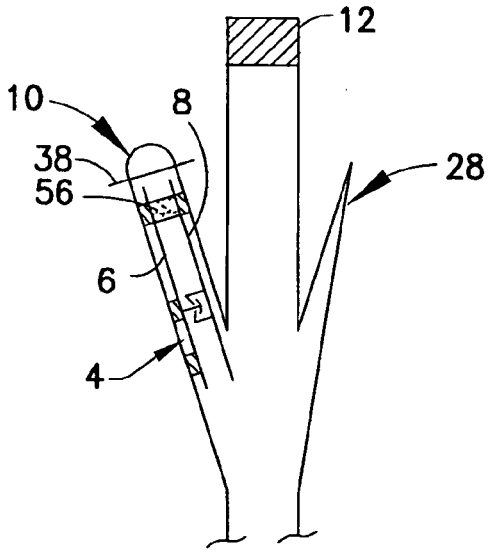
Figure 10:
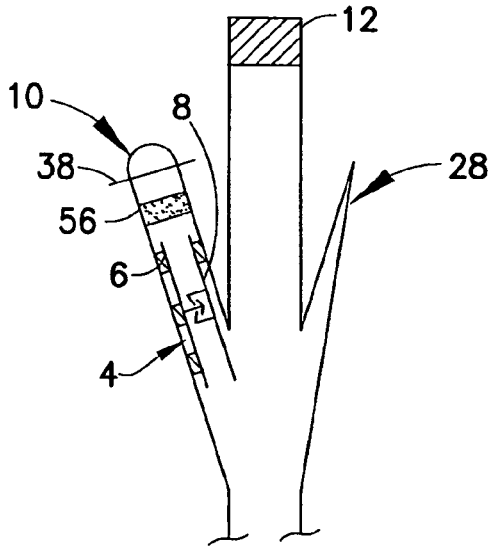

Variations of the embodiment shown in FIG. 1, each variation incorporating a tamper-evident feature, are respectively shown in FIGS. 8-10. The bag shown in FIG. 8 has the same structure as the bag shown in FIG. 1, except that a peel seal 56 is placed between the zipper flanges on the product side of the closure profiles of the zipper 4. In the embodiment shown in FIG. 9, a peel seal 56 is placed between the zipper flanges on the consumer side of the closure profiles. In the embodiment shown in FIG. 10, a peel seal 56 is placed between the front and rear sides of the loop 10 on the consumer side of the closure profiles. Optionally, the peel seal 56 shown in FIG. 10 may be extended into flap 28, since it would be easier from a manufacturing standpoint to apply the peel seal material across the entire film rather than part of it.

In each of the embodiments described above as having a peel seal, the peel seal extends the length of the zipper. The peel seal may take the form of a strip of peelable seal material. The opposing sides of the peel seal are joined to opposing zipper flanges or to opposing sides of the loop and so forth. The peel seal must be designed to peel apart or rupture when the opposing flanges or walls are pulled apart.

One known method of making a peel seal involves the application of respective laminates on opposing portions of the loop or zipper, which laminates extend the full length of the zipper. A peel seal is formed by heat sealing the peel sealable laminates together. Later, when the consumer pulls the opposing portions of the loop or zipper apart, the peel seal will rupture. During rupture of the peel seal, one or more layers of one laminate disengages from the other layer or layers of that laminate and remain adhered to the other laminate. As a result, the other laminate will include at least one additional layer after the peel seal has been broken. The disengagement of the one layer from the first laminate is accomplished by using layers composed of different polymeric materials, with the resulting adjacent layers having varying bond strengths between the layers. The rupture will occur between the two layers of the peel seal that have the lowest bond strength.

Another known method of making a peel seal involves adhering a respective layer of film to opposing portions of the loop or zipper, which film layers extend the full length of the zipper, wherein one or both of the film layers contains contaminants. When the peel seal is formed by heat sealing the film layers together, the bond between them is weak due to the surface contamination. The film layers detach from each other during rupture of the peel seal.

One known composition of a heat-sealable peel seal material consists of ethylene vinyl acetate copolymer, polyethylene-based wax and polypropylene. Another known composition is a blend of polybutylene and low-density polyethylene. Many other peel seal compositions are known. For example, peel seals can be created using a variety of known pressure-sensitive adhesives.

Figure 11:
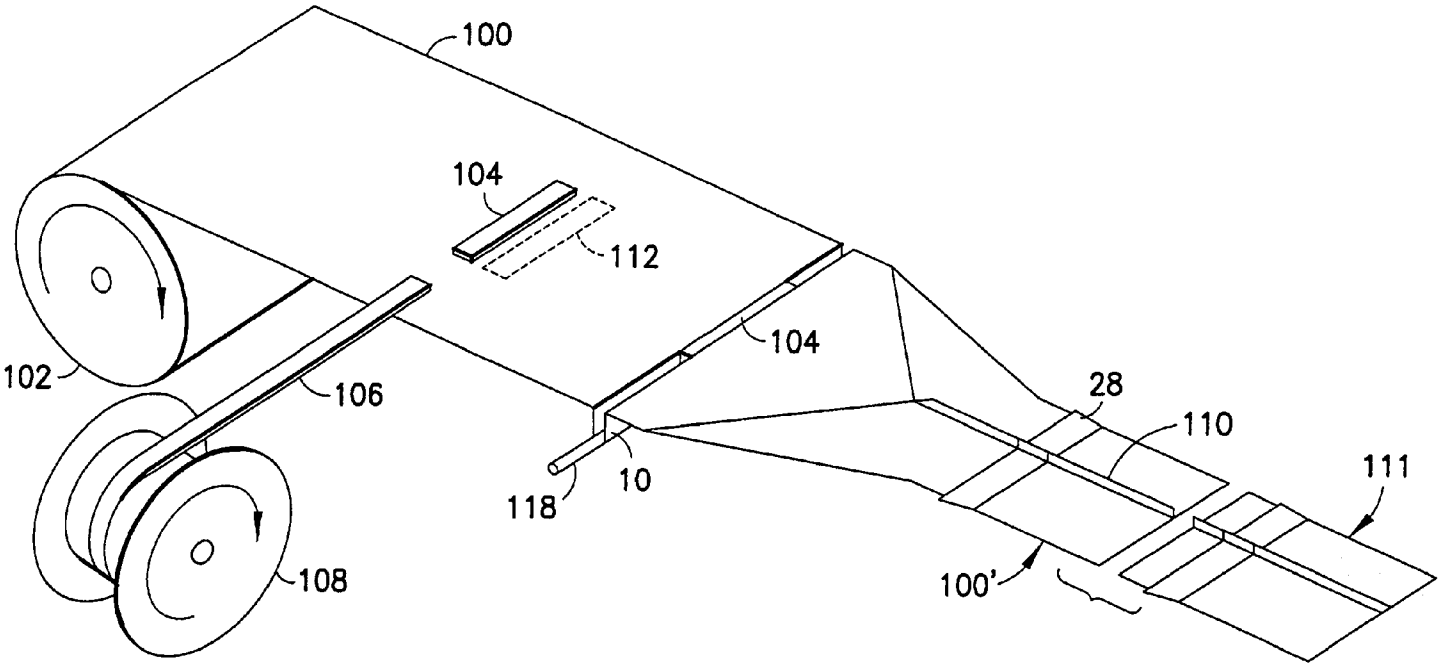
FIG. 11 is a drawing showing an isometric view of work in process in accordance with one method of manufacturing either of the embodiments shown in FIGS. 1 and 2. In accordance with this method, a zipper is attached to a web and then a loop that captures the attached zipper is formed in the web.

A first method of manufacturing bags of the types disclosed herein is generally depicted in FIG. 11. A web 100 of packaging material (e.g., thermoplastic film) is paid out from a supply roll 102. The web has a constant width with mutually parallel lateral edges on each side. The web 100 can be advanced intermittently toward a horizontal or vertical FFS machine (not shown) by conventional feed drive rollers and/or drive belts under the control of a programmed logic controller (PLC). The most recently paid-out portion of the web passes through a zipper application station, where a zipper segment 104, comprising a pair of interlocked zipper strips, is applied transverse to the direction of web advancement (hereinafter "the machine direction").

For each length of bag making film corresponding to an individual package, a respective zipper segment 104 is attached transverse to the film. The length of the zipper assembly will be less than one-half of the film width and will typically be placed in a central position relative to the lateral edges of the web. The zipper segment 104 may be laid directly on the film 100, but preferably is fed laterally across the upper surface of the film at right angles to the longitudinal edges of the film, or in other words at right angles to the longitudinal formation axis of the film. The positioning device can take any of a variety of forms well known to those skilled in the art of manufacturing reclosable packages on FFS machines, such as a vacuum conveyor for pulling the distal segment of the zipper tape across the film. A zipper tape 106 is paid out from a supply reel 108 and guided to a sealing and cutting station (not shown) by a conventional zipper guide (not shown). When the distal segment is in proper position, a knife or other cutting instrument (not shown) severs a zipper segment 104 from the end of the zipper tape 106.

Figure 12:
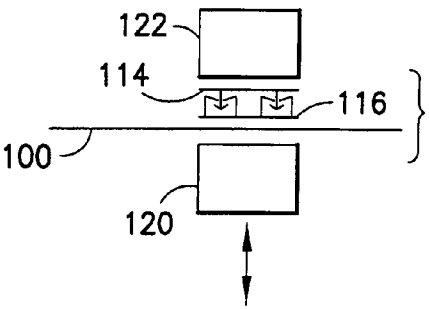
FIG. 12 is a drawing showing a side view of apparatus for performing a zipper application step in accordance with the method depicted in FIG. 11.

FIG. 12 shows an end view of a severed zipper segment comprising a pair of flangeless zipper strips 114 and 116 having two pairs of mutually interlocked closure profiles. The back of the zipper strip 116 is heat sealed to the bag making film 100 along a transverse band-shaped zone of joinder, e.g., using a pair of mutually opposed sealing bars 120 and 122. Sealing bar 120 is heated and reciprocates, while sealing bar 122 is stationary and not heated. The heated sealing bar applies sufficient heat to cause thermoplastic film material of the web 100 to soften or melt and then fuse to the zipper strip upon cooling, thereby forming a band-shaped zone of web/zipper joinder along the zipper segment. The other zipper strip 114 is interlocked with the attached zipper strip and is thus maintained in place.

Alternatively, the zipper strips may have flanges and the zipper flange adjacent the web of packaging material may be heat sealed to the web along one or more band-shaped zones. For example, as previously described, the zipper flange 6 seen in FIG. 1 is attached to the loop by three heat seals.

It should be appreciated that the embodiment shown in FIG. 2 can also be manufactured in accordance with the methodology depicted in FIG. 11. In that event, a split sealing bar (of the type designated by numeral 142 in FIG. 15 described in detail hereinafter) is used to initially seal the zipper segment to the web.

Referring again to FIG. 11, before the web portion with attached zipper segment is indexed forward, a rectangular line 112 of weakened tear resistance is formed in the web. The rectangle has a length approximately equal to the length of the zipper segment 104. The lateral portions of the film 100 beyond the ends of the attached zipper segment 104 are sufficiently long so that they can eventually be folded over and sealed together along a fin or lap seal 110.

After the zipper segment 104 has been attached to the web 100 and the rectangular tear line 112 has been formed, the web is indexed one bag length. A retractable forming bar 114 pushes the web and attached zipper segment downward between two closely spaced rollers (not shown in FIG. 11) to create a loop. The attached zipper segment 104 is pulled down into the loop and the portion of the web to which it is attached now forms part of one side of the loop.

In cases where the zipper segment is to be attached to both sides of the loop, the unsealed zipper strip is attached to the opposite side of the loop by conductive heat sealing. Again this can be accomplished in conventional fashion using a pair of sealing bars, one of which is heated, the heated sealing bar being located on the side of the loop next to the unsealed zipper strip. The joinder of both sides of the loop to opposing sides of the zipper segment, along the latter's entire length, maintains the shape of the loop.

In the case where the zipper segment is to be attached to the front side of the loop only, the loop is formed as described above, but the back side of the zipper segment is not sealed to the opposite side of the loop. Instead respective portions of the opposing walls of the loop, which portions extend beyond the ends of the zipper segment, are joined together by conductive heat sealing in areas above the forming bar in order to maintain the shape of the loop. These joined portions of the loop will later become a flap analogous to flap 28 shown in FIG. 2, except that the flap walls are joined together to form a double layer.

Because both sides of the loop are either joined to each other at the ends (to make the embodiment of FIG. 2) or joined to the zipper (to make the embodiment of FIG. 1), the forming bar cannot simply ascend to its starting position above the loop. Accordingly, the forming bar 118 must be retracted from the side by displacing it along its own axis. After the forming bar has been pulled out of the loop from the side, the bar can be lifted and then returned to its starting position.

After the foregoing steps have been performed, the web with zippered loops is pulled through an FFS machine by conventional means. In the FFS machine, the web with attached zippers is folded or wrapped into a tube with the lateral edges of the web overlapping or confronting each other. Then the lateral edges of the web are sealed (fin or lap seal) together to create a back seam 110 (see FIG. 11). In particular, the lateral edges of the section of the web that forms the loop are sealed together. After the back seam has been formed, the top and bottom bag seals are made (not shown in FIG. 12). Each of the foregoing seals can be formed by conventional conductive heat sealing of thermoplastic web material. The top and bottom seals define the front and rear walls of the bag, and likewise define the loop 10 and flap 28 seen in FIGS. 1 and 2. The tube is cut along two transverse lines to form an individual package that is sealed at the top and the bottom by the aforementioned top and bottom seals respectively.

The FFS machine may be of the horizontal or vertical variety. In the case of a horizontal FFS machine, product may be placed on top of the web before the tube is formed and then cross sealed to form a receptacle that encloses the product. The details of operation of such horizontal FFS machines are well known in the art and will not be repeated here.

In the case of a vertical FFS machine, the web 100 carries the transversely applied zipper segment 104 over the crown of a forming collar (not shown) and into a gap between the collar and the fill tube. The web of film is drawn over the forming collar, through the gap between the forming collar and the fill tube, and around the fill tube to form a generally cylindrical shape. Then a vertical seam 110 (e.g., a fin seal or a lap seal) is formed by known methods, e.g., by conventional conduction heat sealing using a pair of vertical sealing bars (not shown), thereby forming a film tube 100'. At the same time, downstream of the portion of the web that is wrapped around the fill tube, a preceding web portion (formed into a tube during an earlier work cycle) is cross sealed to form a bottom seal for the bag about to be filled. The product being packaged is then dropped through the fill tube and into the bag to be filled. Typically, at the time of filling, bag being filled has a bottom seal that was formed when the immediately preceding bag was completed by making a top seal, the top and bottom seals being formed by a pair of reciprocating cross sealing jaws in conventional fashion. After filling, the filled portion of the tube is indexed forward one package length. Then the top of the instant bag and the bottom of the next succeeding bag are sealed by the same cross sealing jaws. Each cross sealing jaw comprises a respective pair of mechanically linked horizontal sealing bars. The sealing bars of at least one cross sealing jaw are heated to a temperature that causes the opposing sides of the tube to seal together during a preset dwell time (controlled by a programmable controller not shown) while the cross sealing jaws are maintained in their extended positions, thereby forming a top seal of the just-filled bag and a bottom seal of the immediately succeeding unfilled package. The temperature of each heated sealing bar is controlled by a programmable heat controller. Typically, a knife is incorporated in one of the cross sealing jaws, while a backing member for supporting the film during cutting is incorporated in the other cross sealing jaw. When the cross sealing jaws are in their respective extended position, the opposing walls of the film are cut as the cutting edge of knife bears against the backing member with the film therebetween. The cut line is located between the top and bottom seals and severs a completed package 111 from the remainder of the work in progress.

It is not necessary that the cross sealing bars consist of spaced-apart sealing bars. A single set of wider sealing bars could be used provided that the transverse cutting instrument were designed to cut in a subsequent operation instead of concurrently.

The operations of the vertical FFS machine are controlled in accordance with a predetermined routine dictated by a programmed logic controller (PLC) (not shown in the drawings). The film tube can be advanced (downwardly) by any conventional means, such as drive belts (not shown) that bear against the film wrapped around the fill tube. To implement indexing of the film tube using drive belts, for each drive belt a gearbelt pulley is mounted to the end of the shaft of one of the belt rollers. The pulley is driven by a gearbelt, causing the roller to rotate. The PLC controls a servomotor, which in turn drives the pulley, causing the roller to rotate to the extent needed to advance the film tube by the indexing distance. The temperature of each heated sealing bar is controlled by a programmable heat controller (not shown). The dwell time of each heated sealing bar in the extended position is controlled by the PLC.

Figure 13:
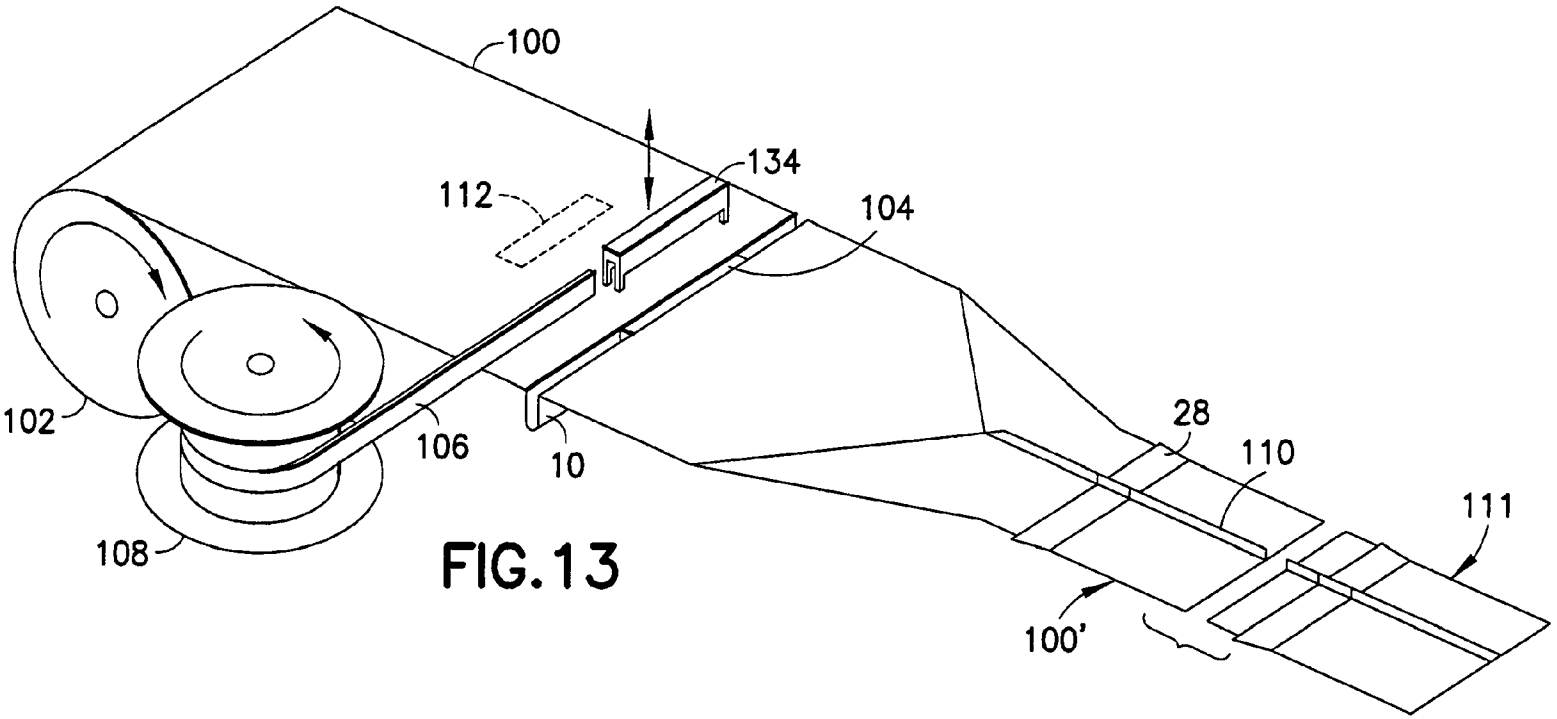
FIG. 13 is a drawing showing an isometric view of work in process in accordance with another method of manufacturing either of the embodiments shown in FIGS. 1 and 2. In accordance with this method, a loop is formed in a web and then a zipper is inserted vertically into the loop and joined thereto.

A second method of manufacturing bags of the types disclosed herein is generally depicted in FIG. 13. A web 100 of a type previously described is paid out from a supply roll 102 and advanced intermittently toward a horizontal or vertical FFS machine by previously described conventional means.

At a first station, a rectangular line 112 of weakened tear resistance is formed in the web. The rectangle has a length approximately equal to the length of a zipper segment 104. Each tear line 112 is located such that it will eventually form a respective removable cap (for bags of the type depicted in FIG. 1) or removable front panel (for bags of the type depicted in FIG. 2) on each looped portion of the web.

After formation of the tear line 112 in a transverse section of the web, that transverse section is indexed forward until it reaches a loop formation and zipper insertion station. At the same time, a zipper tape 106 is paid out from a supply reel 108 and fed into a receiver 134 by means of a conventional zipper guide (not shown). The receiver is disposed transverse to the machine direction and above an intermediate portion of the web, as seen in FIG. 13. The receiver may be provided with suitable means for gripping or holding the zipper segment. For example, the receiver could be provided with channels that are in flow communication with a vacuum source (not shown), the zipper strips being held in place by suction. Alternatively, retaining ledges may be incorporated in the receiver for retaining the zipper strips in place. When the distal segment of the zipper tape is being held inside the receiver 134, a knife or other cutting instrument (not shown) severs a zipper segment 104 from the end of the zipper tape 106. The length of the zipper segment is less than one half the width of the web 100.

Figure 14:
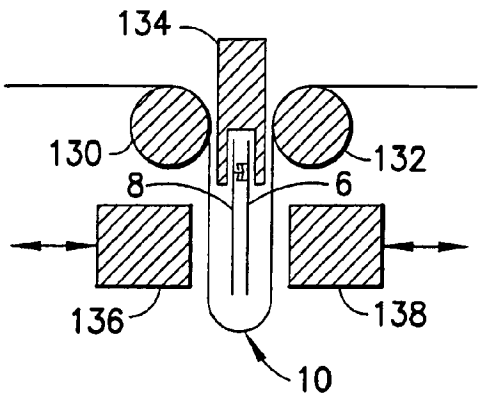
FIG. 14 is a drawing showing a sectional view of apparatus for forming the loop, inserting the zipper vertically, and then joining the zipper to both sides of the loop in accordance with the method depicted in FIG. 13. The section line is taken through the midplane of the receiver.

The receiver 134 reciprocates vertically between the position shown in FIG. 13 and the position shown in FIG. 14. In accordance with the embodiment shown in FIG. 14, the receiver 134 is designed to receive and carry a flanged zipper 4 comprising respective zipper strips 6 and 8 having mutually interlocked closure profiles. The receiver depicted in FIG. 14 comprises a pair of mutually parallel vertical walls with a portion of the zipper segment therebetween, each vertical wall having a respective extension or leg at each end, giving the receiver four vertical legs at respective corners. When the receiver 134 is lowered from the position shown in FIG. 13 to the position shown in FIG. 14, the receiver legs press against the inside (product side) of the web 100 while the outside of the web is supported by respective rollers 130 and 132 upstream and downstream of the receiver 134, as seen in FIG. 14. Pushing the web between rollers 130 and 132 creates a loop 10.

The zipper segment held by the receiver 134 is then joined to opposing sides of the loop by conventional conductive heat sealing. FIG. 14 shows the situation wherein the loop is designed with a tear-away top and the zipper segment (item 104 in FIG. 13) comprises zipper strips 6 and 8 of the type seen in FIG. 1. Respective reciprocating sealing bars 136 and 138 on opposing sides of the loop 10 will seal the flanges of the respective zipper strips 6 and 8 to the front and rear sides of the loop 10 respectively while in their extended positions. During the zipper sealing operation, seal-through of the zipper flanges may be prevented by the application of a coating of non-sealant material to the mutually confronting inner surfaces of the zipper flanges.

Thereafter, the sealing bars 136 and 138 are retracted and the suction applied by the receiver is turned off, thereby releasing the zipper segment. Then the receiver 134 is retracted to the position seen in FIG. 13, leaving the zipper segment 104 inside and attached to both sides of the loop 10.

Figure 15:
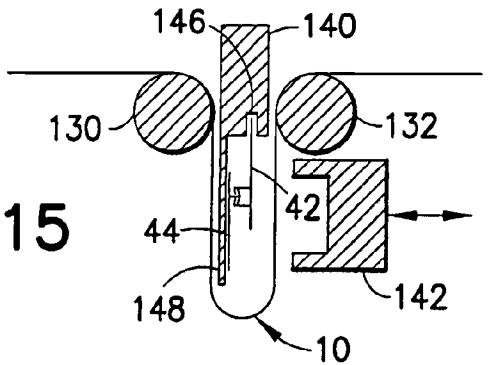
FIG. 15 is a drawing showing a sectional view of apparatus for forming the loop, inserting the zipper vertically, and then joining the zipper to one side and not the other side of the loop in accordance with the method depicted in FIG. 13. The section line is taken through the midplane of the receiver.

FIG. 15 shows the situation wherein the loop is designed with a tear-away panel on the front side, while the zipper segment (item 104 in FIG. 13) comprises zipper strips 42 and 44 of the type seen in FIG. 2. In this implementation, the receiver 140 differs in structure from the receiver 134 shown in FIG. 14 in order to accommodate the zipper strips 42 and 44. More specifically, the receiver 140 has a slot 146 for receiving a distal portion of the flange of zipper strip 42 and has an extension wall 148 with suction channels (not shown) that are in flow communication with a vacuum source (not shown), the zipper strip 44 being held in place against wall 148 by suction. Other means for holding the zipper in place can be utilized.

The receiver 140 holds the zipper strips 42 and 44 during cutting of the distal end of the zipper tape to form a zipper segment. When the receiver 140 is lowered from a position above the web to the position shown in FIG. 15, the receiver extension wall 148 presses against the inside (product side) of the web 100 while the outside of the web is supported by respective rollers 130 and 132 upstream and downstream of the receiver 140 as seen in FIG. 15. Again pushing the web between rollers 130 and 132 creates a loop 10.

The zipper segment held by the receiver 140 is then joined to the front side of the loop 10 by conventional conductive heat sealing. A split sealing bar 142 will seal the flanges of the respective zipper strips 42 and 44 to the front side of the loop 10 while in its extended position, typically by sealing above and below the mating closure profiles of the zipper strips. The split sealing bar can be provided with a respective horizontal bar-shaped projection for each band-shaped zone of zipper/web joinder. FIG. 15 shows the specific example wherein the flange of the each zipper strip is to be joined to the front side (on the right-hand side of the loop as depicted in FIG. 15) of the loop in a respective band-shaped zone of zipper/web joinder. In contrast, FIG. 2 shows the case wherein the flange of zipper strip 42 is joined to the front side of the loop in two band-shaped zones of zipper/web joinder, while the flange of zipper strip 44 is joined to the front side of the loop in one band-shaped zone of zipper/web joinder, in which case a split sealing bar having three horizontal bar-shaped projections would be needed. The extension wall 148 extends the full length of the zipper segment to provide an opposing surface for the split sealing bar 142 to press against during the sealing operation. The vertical extension wall 148 also prevents the zipper flanges being sealed to the rear side (left-hand side in FIG. 15) of the loop during the zipper sealing operation.

The web 100 with attached zipper segments is then folded into a tube, the edges of the web are sealed together to create a back seam, top and bottom bag seals are made, and individual bags are severed from the tube, as previously described with reference to FIG. 11.

Figure 16:
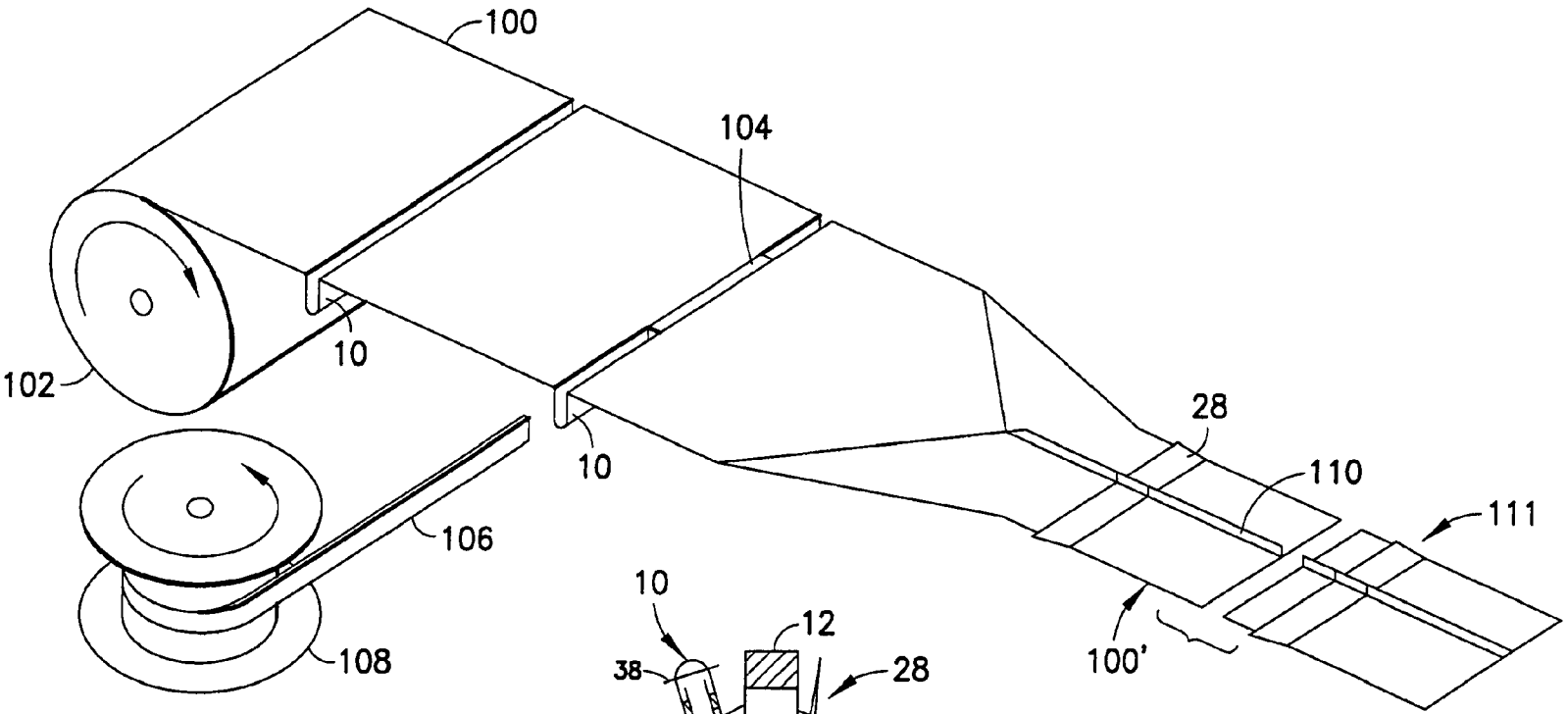
FIG. 16 is a drawing showing an isometric view of work in process in accordance with a further method of manufacturing either of the embodiments shown in FIGS. 1 and 2. In accordance with this method, a loop is formed in a web and then a zipper is inserted laterally into the loop and joined thereto.

A third method of manufacturing bags of the types disclosed herein is generally depicted in FIG. 16. This method differs from the first method described above in that the severed zipper segment 104 is inserted into the loop 10 from the side instead of from above. In one implementation, a distal end of the zipper tape 106 having a length equal to one zipper segment can be inserted into the loop from the side; then a knife or other cutting instrument cuts the zipper tape at the exact location that will sever one zipper segment. That zipper segment can then be displaced from a position starting at one lateral edge of the loop to a position centrally located in the loop, as seen in FIG. 16.

Figure 17:
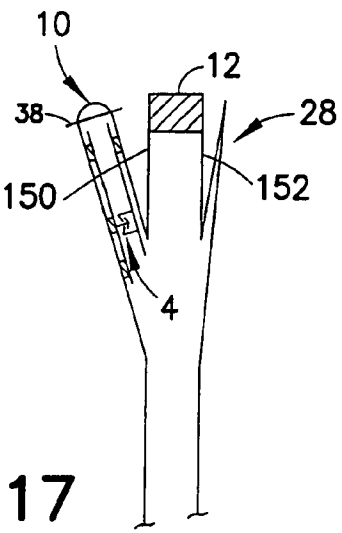
FIG. 17 is a drawing showing a sectional view of a reclosable package in accordance with a further variation of the embodiment depicted in FIG. 1.

By placing the top seal 12 as close to the loop 10 as possible and then sealing the loop 10 and flap 28 and the inside bag walls 150 and 152 together, as shown in FIG. 17, a bag could be produced having the appearance of a so-called bag-top zipper without needing to seal to the back wall of the bag. The result is rollstock having pre-applied zippers that can be made into bag-top zipper bags.

In accordance with respective alternatives for each of the methods of manufacture depicted in FIGS. 11, 13 and 16, the zipper segments are not pre-applied in line with a FFS machine. Instead, after the zipper has been applied and the loop formed, the web with zippered loops is rolled up in a flat state and then stored or transported for future processing on an FFS machine. This obviates the need for the FFS machine operator to modify his equipment to provide for zipper application.

In accordance with further respective alternatives for each of the methods of manufacture depicted in FIGS. 11, 13 and 16, the transverse section of the web of packaging material that will be formed into the loop is notched on both sides of where the zipper segment will be attached, as taught in U.S. Pat. No. 6,530,870. Notching is preferably performed before the loop is formed.

Figure 18:
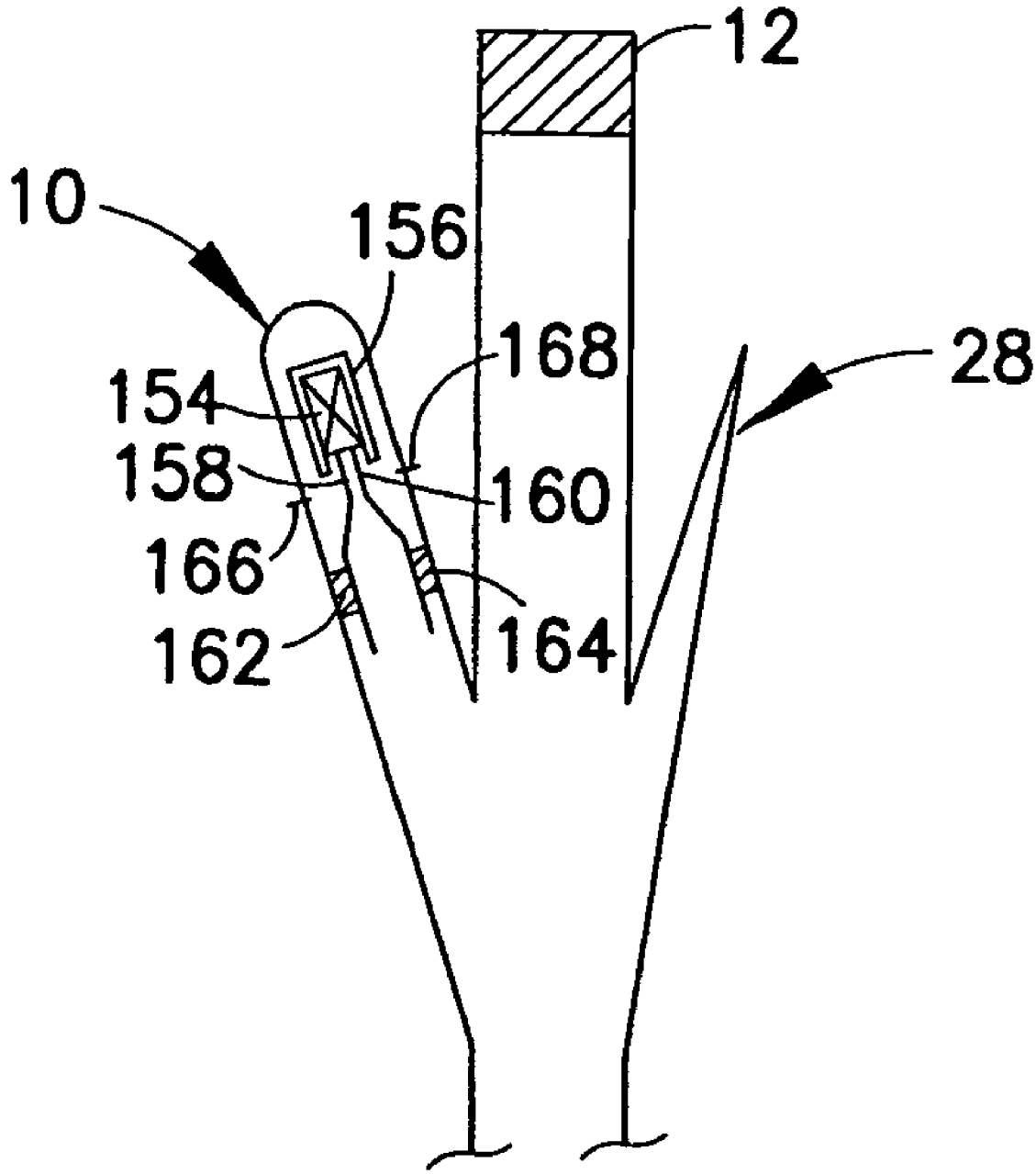
FIG. 18 is a drawing showing a sectional view of a reclosable package in accordance with a further embodiment having a slider-operated zipper.

In accordance with further embodiments of the invention, the zipper may be of the type operated by a slider. One such construction is depicted in FIG. 18. A zipper 154 having a slider 156 mounted to its closure profiles is attached to the front and rear walls of the front loop 10 by means of respective heat seals 162 and 164. Tear lines 166 and 168 can be provided in the front and rear walls of the front loop 10 at elevations below the bottom edges of the slider 156 to allow the top portion of the loop to be torn away by the consumer, thereby exposing the slider-zipper assembly.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, or adhered, whether by application of heat and/or pressure, application of ultrasonic energy, application of a layer of adhesive material or bonding agent, interposition of an adhesive or bonding strip, etc. Also, in the absence of explicit language in any method claim setting forth the order in which certain steps should be performed, the method claims should not be construed to require that steps be performed in the order in which they are recited.

The invention claimed is:

1. A package comprising:

a receptacle comprising front and rear walls joined to each other at top and bottom cross seals and connected to each other along first and second sides of said receptacle, said front wall comprising an upper front panel and a lower front panel, said rear wall comprising first and second sections having respective marginal portions joined by a first segment of a vertical seal to form an upper rear panel and further comprising third and fourth sections having respective marginal portions joined by a second segment of said vertical seal to form a lower rear panel, said receptacle further comprising a loop that projects outward and that extends completely around said receptacle from one side of said vertical seal to the other side of said vertical seal, a first portion of said loop forming a first flap segment that is connected to said first and third sections of said rear wall, and a second portion of said loop forming a second flap segment that is connected to said second and fourth sections of said rear wall; and first and second zipper strips having mutually interlocked profiles, said first and second zipper strips being disposed inside and joined to a third portion of said loop that is connected to said upper and lower front panels.

2. The package as recited in claim 1, wherein said upper front panel and said upper rear panel are joined to each other along said top cross seal, and said lower front panel and said lower rear panel are joined to each other along said bottom cross seal.

3. The package as recited in claim 1, wherein said first and second zipper strips are flangeless.

4. The package as recited in claim 1, wherein said first and second zipper strips comprise respective zipper flanges that are joined to said loop.

5. The package as recited in claim 1, further comprising a slider mounted to said first and second zipper strips.

6. The package as recited in claim 1, wherein said first zipper strip is joined to a front side of said third portion of said loop that is connected to said lower front panel and said second zipper strip is joined to a rear side of said third portion of said loop that is connected to said upper front panel.

7. The package as recited in claim 6, wherein said front side of said third portion of said loop has a first line of weakened tear resistance disposed higher than said first zipper strip, and said rear side of said third portion of said loop has a second line of weakened tear resistance disposed higher than said second zipper strip.

8. The package as recited in claim 1, wherein said first and second zipper strips are joined to a front side of said third portion of said loop that is connected to said lower front panel and are not joined to a rear side of said third portion of said loop that is connected to said upper front panel.

9. The package as recited in claim 8, wherein said front side of said third portion of said loop has a line of weakened tear resistance disposed between respective zones where said first and second zipper strips are joined to said front side of said third portion of said loop.

* * * * *

UNITED STATES PATENT AND TRADEMARK OFFICE

CERTIFICATE OF CORRECTION

PATENT NO. : 7,635,222 B2
APPLICATION NO. : 11/228608
DATED : December 22, 2009
INVENTOR(S) : Plourde et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1132 days.

Signed and Sealed this

Ninth Day of November, 2010

David J. Kappos

David J. Kappos
*Director of the United States Patent and Trademark Office*